US005121838A

United States Patent [19]

Dickie

[11] Patent Number: 5,121,838

[45] Date of Patent: Jun. 16, 1992

[54] PACKAGE HAVING PRODUCT CLAMPING FOR CARD-LIKE PRODUCTS

[75] Inventor: Robert G. Dickie, Newmarket, Canada

[73] Assignee: Intepac Technologies Inc., Ontario, Canada

[21] Appl. No.: 780,980

[22] Filed: Oct. 23, 1991

[51] Int. Cl.[5] ..... B65D 5/48; B65D 81/02

[52] U.S. Cl. ..... 206/334; 206/454; 206/485; 206/589

[58] Field of Search ..... 206/328, 329, 334, 425, 206/454, 485, 491, 586, 589; 229/199, 130, 147, 165, 178, 125.05, 173

[56] References Cited

U.S. PATENT DOCUMENTS

| | | | |
|---|---|---|---|
| 1,301,171 | 4/1919 | Richardson | 229/147 X |
| 2,256,995 | 9/1941 | Andres | 206/485 X |
| 2,620,962 | 12/1952 | Powell | 206/485 |
| 4,339,069 | 7/1982 | Poteet | 229/178 X |
| 4,485,922 | 12/1984 | Desmond et al. | 206/485 |
| 4,511,079 | 4/1985 | Lopez | 229/178 X |
| 4,951,813 | 8/1990 | Sauter | 229/178 X |
| 4,972,954 | 11/1990 | Dickie | 206/523 |
| 5,002,188 | 3/1991 | Dickie | 206/589 |

*Primary Examiner*—Paul T. Sewell
*Assistant Examiner*—Jacob K. Ackun, Jr.
*Attorney, Agent, or Firm*—Donald E. Hewson

[57] ABSTRACT

A package for one or a plurality of card-like items is provided, having a protective outer shell and an inner insert into which the card-like items may be placed. The shell and insert may be a monolithic structure, or they may be produced separately, possibly of different materials—although both are typically corrugated cardboard. The insert has front, bottom, and rear articulated panels, each having a fold line along the length thereof so that each panel protrudes inwardly into the interior of the shell at the fold line, and a cover panel. At least one and usually a plurality of slots is formed in each of the articulated panels, so that an edge of any card-like item to be placed into the package is inserted into the slots. In general, as the edge of each card-like item intrudes into the slot in the bottom articulated panel, and the cover panel is closed over the top edge, at least the rear articulated panel tends to protrude further into the shell to secure the item. Compression tabs are provided to co-operate with the cover panel and the top of the shell, so as to enhance the clamping action for each card-like item. The spaces formed outside the insert and within the shell provide a measure of crush protection for the products, and the articulation of the panels of the insert provide a measure of shock absorption for each card-like item secured within the package.

22 Claims, 2 Drawing Sheets

PACKAGE HAVING PRODUCT CLAMPING FOR CARD-LIKE PRODUCTS

FIELD OF THE INVENTION

This invention relates to packaging, and particularly packaging within which at least one, and very often a plurality, of card-like items may be secured. The card-like items may particularly be high technology, solid state printed circuit cards such as those that may be used for telephones, computers, in aerospace application, and the like.

BACKGROUND OF THE INVENTION

The present invention is particularly intended to provide a package in which high technology cards may be shipped, it being understood that generally such cards may have limited tolerance to abusive handling, and are usually relatively expensive. Moreover, such cards may be such that a visual inspection of them when they are in the hands of the intended recipient might not necessarily indicate whether any such card is still functional.

The intent of the present invention is to provide a package, within which one card-like item, or a plurality of identical or substantially similar items may be placed. When the package is intended to secure a plurality of card-like items in place, it may be termed a "bulk package". It is moreover the intent of the present invention to provide a package in such a manner that it may be produced using ordinary die-cut procedures, and shipped flat to the factory that will use it, and which may be easily and quickly erected. That characteristic provides for economies of shipping costs and storage space, in that the packages of the present invention are only shipped in their erected condition when they are filled.

Still further, a purpose of the present invention is to provide packaging which is benign as to environmental concerns. Specifically, the package of the present invention employs no foams or plastics, products which are environmentally unfriendly as to their production and even more so as to the problems encountered in disposing of them. The present invention employs cardboard, usually corrugated cardboard, which may be easily produced from re-cycled paper products, and which themselves may be re-cycled or are in any even relatively easily biodegradable. Such practices also generally help to reduce costs of production and costs to the end user.

As noted, the present invention provides an outer protective shell, having generally rectangular configuration, and an inner securing insert for the plurality of card-like items to be placed in the package. The outer shell has first and second ends, at least one front panel, a top panel, a back panel, a bottom panel, and at least one end panel at each end. Typically, for easy erection purposes, without the necessity for the used of any adhesives, the structure of the shell comprises two front panels and two panels at each end, and is such that a locking panel at each end o the outer front panel may be inserted between the respective end panels so as to secure the outer shell in a closed condition.

The inner securing insert has front, bottom, and rear articulated panels, and at least one cover panel. Each of the articulated front, bottom, and rear panels has a generally centrally located fold line along its length. Thus, each of the articulated panels protrudes inwardly at its respective fold line into the interior of the shell.

In each of the articulated panels there is provided at least one slot—and in the case of a bulk package, a plurality of slots—each of which extends across the fold line of the respective articulated panel. An edge of a card-like item to be secured within the package may be inserted in the slots. Standoffs are ranged along the fold line of each of the articulated panels, each standoff being located at each side of a respective slot.

The insert is such that, when the at least one card-like item is placed into the respective slots, the at least one cover panel is arranged to be secured in place over the card-like item in a closed position. As discussed hereafter, a clamping force may be exerted downwardly on the card-like item by the cover panel. Moreover, at least one compression tab is located at least at the top edge of the rear articulated panel, and the at least one compression tab is arranged so as to extend upwardly towards the top panel of the shell and to contact the underside of that top panel. Thus, the length of each of the at least one compression tab is sufficient so as to assure interference of its end with the bottom surface of the top panel when the shell is closed; and that in turn causes the rear articulated panel of the insert to tend to protrude further into the interior of the insert at its fold line.

BRIEF DESCRIPTION OF THE DRAWINGS

The present invention will be described hereafter in association with the accompanying drawings, in which.

DESCRIPTION OF THE PREFERRED EMBODIMENTS

Figure 1:
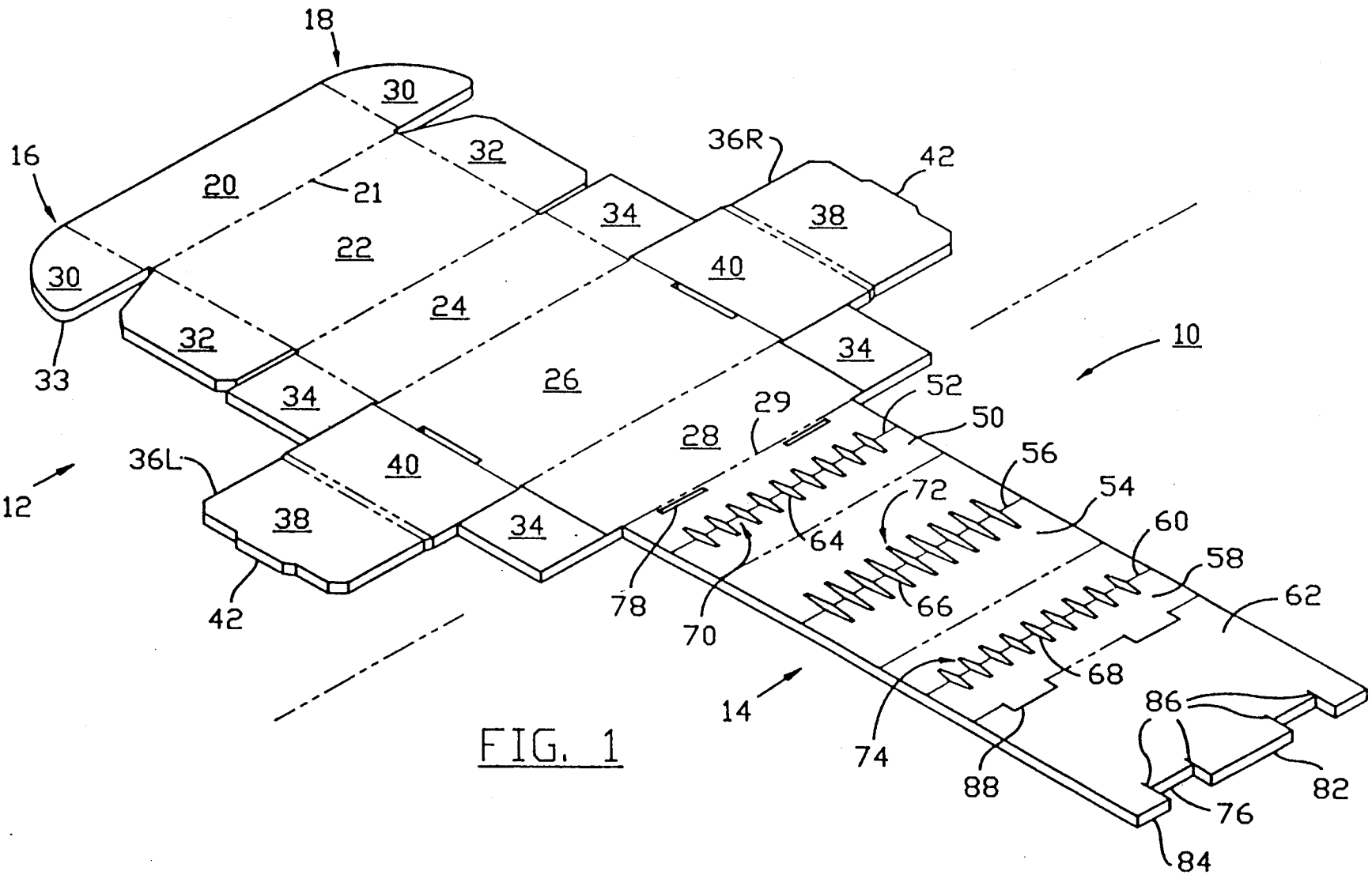
FIG. 1 is a perspective view of a preferred embodiment of the package of the present invention, when used as a bulk package and formed as a monolithic structure, in its collapsed condition.

Turning first to FIG. 1, the principal components of the package of the present invention are identified:

First, the package identified generally at 10 comprises an outer rectangular protective shell identified generally at 12, and an inner securing insert identified generally at 14. The shell 12 and insert 14 may be formed as a monolithic structure, or they may be formed as two separate structures. In general, the package having the shell 12 and insert 14 is formed using well known die-cut procedures, from cardboard of suitable weight and structure such as a light weight single core corrugated cardboard.

The outer shell and the insert, when assembled, will each have two ends, and are otherwise of generally rectangular configuration in each access. In the configuration shown in FIG. 1, the first or left ends of each of the shell 12 and insert 14 are at 16, and the right ends of each of the shell 12 and insert 14 are at 18.

The outer shell 12 generally comprises an outer front panel 20, a top panel 22, a back panel 24, a bottom panel 26, and an inner front panel 28. At the ends of the outer front panel 20 there are a pair of front locking panels 30. Likewise, at the ends of the top panel 22 there are a pair of top flaps 32.

The ends of the shell are shown at 36L and 36R; and in the usual configuration, each of the end panels comprises an inner end panel 38 and an outer end panel 40. When the shell is erected, the end panels 38 and 40 are retained in place by a retaining tab 42 inserted into a retaining tab lockout 44, in each case. The fold line between the panels 38 and 40 at each end may be a double score as indicated at 39; and when erected, lap panels 34 that are secured to the ends of the back panel 24 and the inner front panel 28 are inserted between the facing surfaces of the inner end panel 38 and the outer end panel 40 at each respective end of the shell.

The lines delineating the various panels are generally formed by scoring, such as shown at 21 between the outer front panel 20 and the top panel 22.

As noted, the shell 12 and insert 14 may be a monolithic structure, and if so they are delineated at fold line 29. Otherwise, the shell 12 and insert 14 may be formed as separate structures; and in either event, line 29 indicates the upper edge of the inner front panel 28.

Turning now to the shell 14, it comprises a front articulated panel 50, a bottom articulated panel 54, and a rear articulated panel 58. Each of the panels 50, 54, and 58 has a generally centrally located fold line along its length, as shown at 52, 56, and 60, respectively. The insert 14 also comprises a cover panel 62—which is typically a single panel but which might comprise a pair of panels. In the latter case, the insert is separately formed, and one of the cover panels would extend from the top of each of the front and rear articulated panels 50 and 58.

Figure 2:
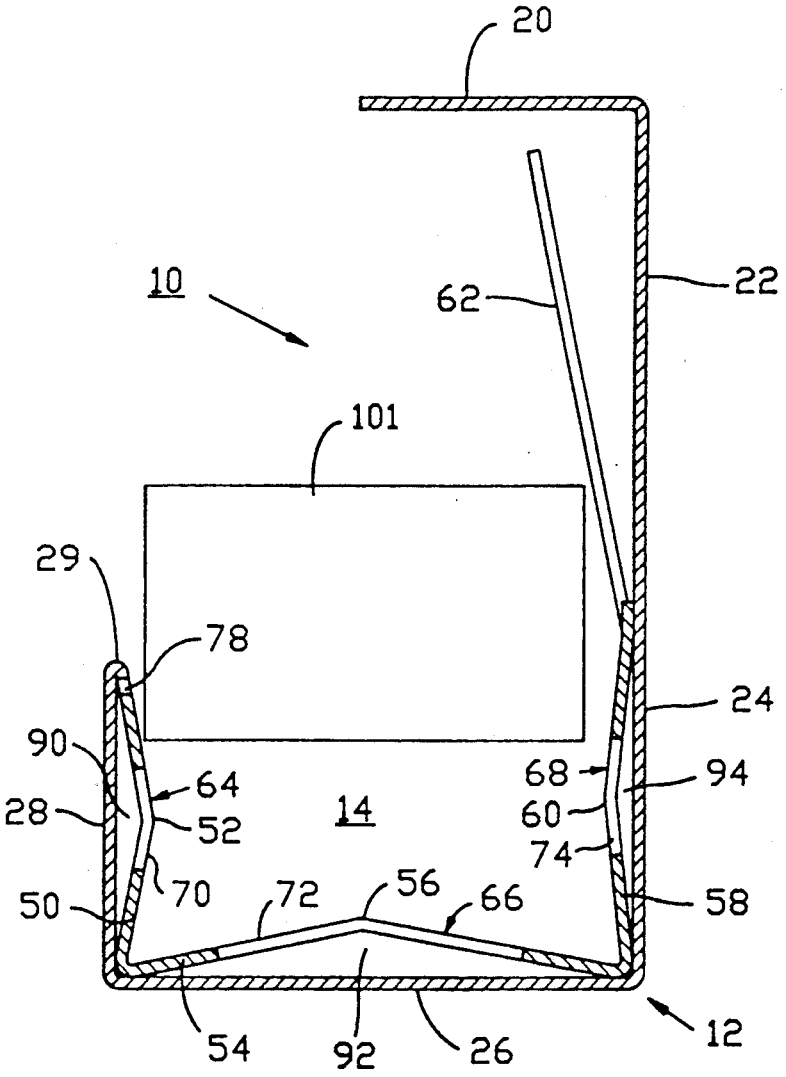
FIG. 2 is a partially schematic end view of a package of the present invention showing a card-like item being put into place.
Figure 3:
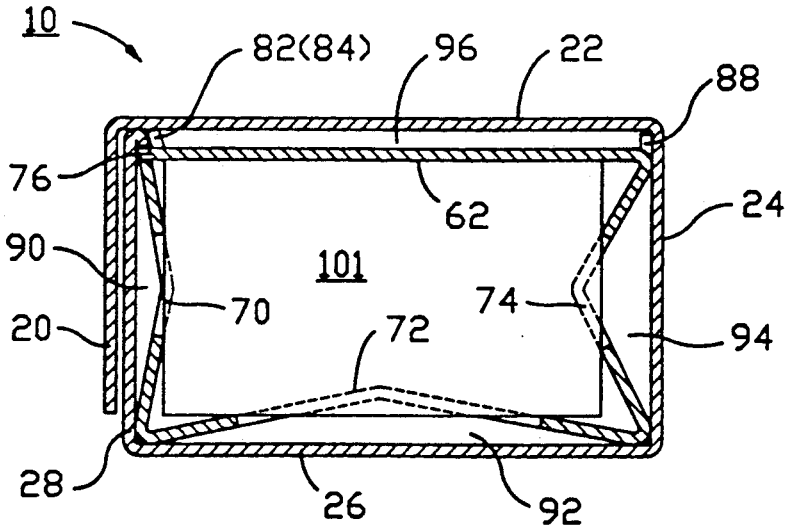
FIG. 3 is a view similar to FIG. 2 with the card-like item in place and the package being closed.

Each of the articulated panels 50, 54, and 58 is scored or creased in such a manner that when the insert is erected, each articulated panel protrudes inwardly at its respective fold line into the interior of the shell, as shown in FIGS. 2 and 3.

There is typically a plurality of slots formed in each of the panels 50, 54, and 58. The slots 64 are formed in articulated panel 50, ranging along its length, and extending across the fold line 52. Likewise, slots 66 are formed in the bottom articulated panel 54, and slots 68 are formed in the rear articulated panel 58. The lengths of each of the slots 64, 66, and 68 depend to some extend on the size of the card-like items for which the package is specifically designed, and as discussed hereafter. Usually, the slots 64 and 68 are substantially identical, and the slots 66 may be somewhat longer than the slots 64 or 68. Obviously, there is an equal number of slots in each of the articulated panels, and they are aligned so that they will accommodate the edge of a card-like item as it is placed in the insert for the purpose intended. Obviously, a single slot could be formed in each of the articulated panels when it is determined that only a single card-like item will be secured within the package of the present invention.

The slots 64 define standoffs 70 which are found between each adjacent pair of slots 64. Likewise, standoffs 72 are found between adjacent pairs of slots 66, and standoffs 74 are found between adjacent pairs of slots 68. The standoffs form part of each of the respective articulated panels, and span the respective fold lines. Thus, the standoffs serve the purpose of forming a locating means with a slot or opening between them when the articulated panels are folded, thereby precluding movement from one side to the other of the card-like members when placed in the slots and secured therein by the standoffs.

When the insert 14 is closed, locking tabs 76, which are found at the front edge of the cover panel 62 are inserted into locking tab cutouts 78 which are formed near the top edge of the front articulated panel 50. However, as noted in FIG. 1, when insert 14 is first die-cut, the locking tabs 76 lie behind and in the same plane as the protruding compression tabs 82 or 84. Those compression tabs 82 and 84, however, may be turned upwardly as shown in FIG. 3, when the insert 14 is erected, thereby freeing the locking tabs 76 to be inserted into the locking tab cutouts 78. The locking tabs 76 are delineated from the adjacent compression tabs 82 and 84, in the embodiment shown in FIG. 1, by cuts 86 which protrude rearwardly from the front edge of the cover panel 62.

Alternatively, the cover panel 62 may comprise two panels, and in that case the panels would extend from the top edges of the respective front articulated panel 50 and the rear articulated panel 58. Moreover, it is not mandatory that the cover panel 62 includes the locking tabs 76, since the cover panel may be secured in place solely by the action of the compression tabs 82 and 84—or alternatively by other means such as an interference of the top of the cover panel 62 with the underside of the top panel 22 of the shell.

Further compression tabs 88 are formed so as to be at the top edge of the rear articulated panel 58. The length of each of the compression tabs 82, 84, 88 is sufficient that the top edge of each compression tab interferes with the bottom surface of the top panel 22 of the shell 12 when the shell is closed over the insert 14 which is in place within the interior of the shell 12. As will be noted in FIG. 3, the downward force of the underside of the top panel 22 against the compression tabs 82, 84, 88 will cause at least the front articulated panel 50, and the rear articulated panel 58 to tend to protrude further into the interior of the insert 14 at their respective fold lines 52 and 60.

Turning to FIGS. 2 and 3, which use identical reference numerals for identical features as described above with respect to FIG. 1, it will be seen that a card-like item 101—which might, for example, be a telephone card or a computer card, or the like—is about to be placed into the package. It will be noted that the package has been erected, with the outer shell 12 being exterior of the insert 14. The edge 29 is noted between the inner front panel 28 and the front articulated panel 50, and it is clear that the edge 29 could be two edges whereby the insert 14 is a separate structure from the shell 12. The following description is of a typical package, but is not limiting as to the precise features thereof.

When first erected, the shell 12 is assembled by folding end panels 38 and 40 together, and inserting the tabs 42 into their respective cutouts 44. Then, the front and rear panels 28 and 29 are folded upwardly and the lap panels 34 are inserted between the inner facing surfaces of the end panels 38 and 40 at each end of the shell. When the sell 12 is closed, the top panel 22 is folded down, and the top flaps 32 are inserted into the interior of the shell so as to pass between the surface of the end panel 38 that faces into the interior of the shell at each end and the ends of the cover panel 62 of the insert which will already have been erected and closed, as discussed hereafter.

Finally, to close the shell, the outer front panel is placed over the inner front panel 28, and the front locking panels 30 are inserted between the inner facing surfaces of the end panels 38 and 40 at each of the shell. The panels are so dimensioned that when the locking panels 30 are in place, they interfere at their top edges 33 with the lower side of the fold 39, thereby assuring that the top panel 22 is retained in its position. There will also generally be a frictional engagement whereby the lap panels 34 and the locking panels 30—and perhaps even the top flaps 32—are secured in place. Generally, the dimensioning of the panels is such that the top panel 22 will interfere with and create a downward force against the top edges of the compression tabs 82, 84, 88.

The insert 14 is erected by folding the articulated panels 50, 54, and 58 in such a manner that the creases between them that face into the interior of the insert 14 form an acute angle. Thus, each of the articulated panels 50, 54, 58 protrudes inwardly at its respective fold lines 52, 56, 60 into the interior of the shell 14. In this manner, each of the slots 64, 66, 68 is well defined by the respective standoffs 70, 72, and 74.

It should be noted, in passing, that the slots 64, 66, 68 may be formed by die-cutting or stamping such that the material of the blank sheet from which the insert 14 is formed is completely removed. However, it may also be such that the material or chaff which is formed by the slots remains; and in that case, the chaff will generally extend towards the respective panels of the shell when the insert is placed into the shell—especially when the card-like items are placed into the slots.

One feature of the particular manner in which the respective articulated panels of the insert 14 are dimensioned, becomes clear upon analysis of FIGS. 2 and 3 and certain differences that are evident between them.

In particular, as the card-like items 101 are placed into the insert 14 so that their edges slide down through the respective slots 64 and 68, the bottom edge of the card-like items 101 will enter the slots 66 formed in the bottom articulated panel 54. Then, as the card-like items 101 are pushed downwardly through the respective slots 64 and 68 and into slot 66, the bottom edges interfere with the ends of the slots 66. This may tend to cause the articulated panels 50 and 58, due to their springiness, to protrude further into the interior of the insert 14, thereby forming a more significant clamping action against the card-like items 101.

The clamping action of the insert 14 against the card-like items 101 when placed into it is enhanced by the following features: When the card-like items are substantially in place, the cover panel 62 is folded downwardly across the top edges of the card-like items 101. Then the locking tabs 76—when used—are inserted into the locking tab cutouts 78, and the cover panel 62 is more or less secured in place. Before that happens, or as the cover panel 62 is being put into place, the compression tabs 82 and 84—when used—are bent upwardly. At the same time, the compression tabs 88 at the top edge of the rear articulated panel 58 also extend upwardly. The clamping action of the insert against the edges of the card-like items 101 placed within it is then further enhanced by closing the top panel 22 and locking it into place using the locking panels 30 as discussed above. At that time, the top edges of the compression tabs 82, 84, and 88 interfere with the bottom surface of the top panel 22. The interference of the compression tabs 88 with the undersurface of the top panel 22 causes a force to be transmitted downwardly through the rear articulated panel 58. Since the panel is already in its articulated sense, that force further enhances the tendency of the panel to protrude inwardly towards the interior of the insert 14, and thus enhances the clamping action against the card-like items 101 held within the insert 14.

Likewise, downward pressure exerted against the compression tabs 82 and 84—when used—is transmitted along their respective axes to the cover panel. Then, the secure locking of the cover panel 62 at the locking tabs 76 in the locking tab cutout 78—when used—is enhanced, and that in turn causes a further clamping pressure to be directed downwardly through the front articulated panel 50. In event, the clamping action of the cover panel 62 of the insert 14 against the card-like items 101 secured therein is enhanced. All of the above provides a quite unexpected secure clamping of the card-like items 101 within the package of the present invention, whereby they may be shipped without any substantial risk of damage due to uncontrolled jostling within the package. Moreover, as noted below, the package of the present invention provides a certain degree of crush resistance and shock absorbing characteristics, whereby the card-like products that are placed within the package are afforded an even greater measure of protection.

As noted above, it is possible that the shell 12 can be arranged only so as to have a single front panel 28, and a single end panel 36L and 36R at each end thereof. However, such an arrangement would then generally require either the use of adhesives and additional small lap panels, or the application of an adhesive tape over various intersections of panels of the shell when it is erected. In that matter, the use of lap panels 34 and the outer front panel 20 may be precluded; but in that case, in order to ensure that the downward clamping force against the top ends of the compression tabs 82, 84, and 88 is generated, it would be almost mandatory that an adhesive tape be used between the juncture of the top panel 22 and the then remaining front panel 28.

Likewise, using of the locking tabs 76 and their cooperating locking tab cutouts 78 may be done away with, and likewise so as to ensure the clamping action of the cover panel 62 against the card-like items 101 there would probably be the necessity to employ adhesive tape to close the insert.

Moreover, depending on the size of the card-like items 101 to be accommodated, it may be that the number of compression tabs 82, 84, and 88 may be reduced, so long as there is generally at least one compression tab on the cover panel 62 and the rear articulated panel 58.

Thus, it is clear that any one package design in keeping with the present invention may be adapted to any one specific card-like product, of which a plurality will be placed in the same package, not only by dimensioning the length of the panels of the sell and the articulated panels of the insert, but also by changing the lengths of the slots in the articulated panels. Changing the lengths of the slots in a top-to-bottom fashion of the front and rear articulated panels will accommodate slightly wider or narrower cards; and changing the front-to-back lengths of the slots in the bottom articulated panel will accommodate cards of somewhat different height—in the sense of their placement within the package. In other words, when economies of scale warrant it, the package of the present invention may be very specifically "fine tuned" to the dimensions and design of any specific card-like products.

In each of FIGS. 2 and 3, voids or airspaces 90, 92, and 94 are noted. They occur between the front articulated panel 50 and the inner front panel 28, between the bottom articulated panel 54 and the bottom panel 26, and between the rear articulated panel 58 and rear panel 24, respectively. In FIG. 3 a further void or airspace 96 is shown, which occurs between the cover panel 62 and the top panel 22 when the package of the present invention is closed. The airspace 96 may, however, not be present in some circumstances when it is desired that the top panel 22 of the shell 12 directly overlies and contacts the cover panel 62 of the insert. The voids or airspaces 90, 92, and 94,—and 96 when present—serve several purposed. First, because the insert 14 is placed within the shell 12, and the card-like items 101 retained therein are spaced from the outer surfaces of the shell 12, a degree of crush resistance for the insert and the card-like items 101 is provided. In the event that a force greater than a predetermined force is exerted against any of the panels of the shell 12, they will collapse into the respective voids, and provide crush resistance for the insert 14 and the card-like items secured by it. Thus, use of the package of the present invention more readily assures that the card-like items 101 will arrive at their destination in an undamaged condition.

Moreover, the structure of the present invention provides a degree of shock absorption for the insert and the card-like items that are secured by it. In the event that the package is dropped, or accelerated such as being thrown, any of the voids or airspaces may function substantially as a shock absorber by temporarily changing or tending to change its volume, without damage occurring to the card-like items.

Finally, because the package of the present invention is particularly intended for use with electronics cards and the like, various surfaces within the insert, particularly all of the inside surfaces of the articulated panels 50, 54, and 58, and the cover panel 62, when the insert is erected, may be sprayed or otherwise coated with an anti-static coating or varnish as is well known in the industry. The coating may be applied before the insert—or even the shell in some circumstances—is manufactured by stamping and die-cutting, or after it has been cut, or in some instances just prior to or just following its erection for use.

There has been described a package for a plurality of card-like items, and a typical configuration of such a package has been described for purposes of illustration and exemplification, with regard to the accompanying drawings. The drawings and the specific discussion of the them are not intended to be limiting, but merely exemplary in nature. Thus, the scope of the present invention is defined by the accompanying claims.

What is claimed is:

1. A package for card-like items, said package being collapsible and of generally rectangular configuration;

wherein said package comprises an outer rectangular protective shell and an inner securing insert for at least one card-like item;

said outer shell having first and second ends, at least one front panel, a top panel, a back panel, a bottom panel, and at least one end panel at each of said first and second ends;

said inner securing insert having a front articulated panel, a bottom articulated panel, a rear articulated panel, and at least one cover panel;

wherein each of said articulated front, bottom, and rear panels has a generally centrally located fold line along the length thereof, so that each of said articulated panels protrudes inwardly at its respective fold line into the interior of said shell;

at least one generally narrow slot extending across the fold line of each of said articulated panels, each said slot being such as to permit an edge of a card-like item to be inserted therein so that the edge of that card-like item extends towards the respective front, bottom, and back panels of said shell at the side of each of said articulated panels remote from the interior of said shell; and at least two standoffs ranged along the fold line of each of said articulated panels, said standoffs being located at each side of said at least one narrow slot;

means to secure said at least one cover panel in place over said card-like item when said insert is closed;

at least one compression tab arranged at the top edge of said rear articulated panel, and arranged to extend upwardly towards said top panel of said shell beyond said at least one cover panel;

wherein the length of said at least one compression tab is sufficient that the top edge of each thereof interferes with the bottom surface of said top panel of said shell when said shell is closed, thereby causing said rear articulated panel to tend to protrude further into the interior of said insert at the fold line thereof.

2. The package of claim 1, comprising a plurality of generally narrow slots in each of said articulated panels, whereby a plurality of card-like items may be secured within said package.

3. The package of claim 1, wherein said insert comprises a single cover panel, and said means to secure said cover panel in place over said card-like items when said insert is closed comprises at least one insert locking tab arranged at the front edge of the cover panel and a co-operating locking tab cutout located in the front articulated panel near the top edge thereof, whereby said locking tab may protrude through said locking tab cutout so as to close said insert.

4. The package of claim 1, wherein at least one compression tab is located at a free edge of said at least one cover panel compression tab and is arranged to be turned upwardly towards said top panel of said shell; wherein the length of said at least one cover panel compression tab is sufficient that the top edge thereof interferes with the bottom surface of said top panel of said shell when said shell is closed, thereby transmitting a compression force downwardly through said at least one cover panel compression tab to said at said at least one cover panel so as to secure said cover panel in place when said shell is closed.

5. The package of claim 4, wherein said shell comprises a single cover panel; and wherein when said shell is closed, said compression force is transmitted by said at least one cover panel compression tab downwardly towards said front articulated panel so as to cause said front articulated panel to ten to protrude further into the interior of said insert at the fold line thereof.

6. The package of claim 1, wherein the dimensions of said at least one slot, at least in said bottom articulated panel, is such that when a card-like item is inserted into said slot, and the height of said card-like item is a predetermined height, the top edge of said card-like item will interfere with the bottom edge of said at least one cover panel, and thereby create a clamping force thereagainst which is transmitted thereto from the ends of said slot.

7. The package of claim 1, wherein said shell and said insert are separate structures, and said insert is placed into said shell.

8. The package of claim 1, wherein said shell and said insert are formed from the same piece of material, and are joined together at the intersection of the top edges of each of said at least one front panel of said shell and said front articulated panel of said insert.

9. The package of claim 7, wherein each of said shell and said insert are manufactured from corrugated cardboard.

10. The package of claim 8, wherein said shell and said insert are manufactured from corrugated cardboard.

11. The package of claim 1, wherein said shell comprises an outer front panel and an inner front panel, with said outer front panel being adapted to at least partially overlie inner front panel.

12. The package of claim 11, wherein said end panels of said shell are located at said first and second ends of said bottom panel; and each end comprises an outer end panel, and an inner end panel which folds over the inside surface of said outer end panel; with at least one locking tab at the end of each inner end panel adapted to be inserted into a co-operating end panel locking tab cutout located at the respective end of said bottom panel.

13. The package of claim 11, further comprising a front locking panel at each of said first and second ends of said outer front panel of said shell, wherein said front locking panels are adapted to be inserted between said inner end panel and said outer end panel at the respective ends of said shell.

14. The package of claim 12, wherein a lap panel is located at each of said first and second ends of each of said back panel and said inner front panel of said shell, and said lap panels are adapted to be inserted between said inner end panel and said outer end panel at the respective ends of said shell.

15. The package of claim 13, further comprising a top flap at each of said first and second ends of said top panel of said shell, wherein said top flaps are adapted to be inserted into the interior of said shell proximate the upper portion of the inner surface of each respective inner end panel, and between said inner surface of each respective inner end panel and the respective end of said at least one cover panel of said insert.

16. The package of claim 4, wherein a plurality of insert locking tabs is spaced along said front edge of said cover panel of said insert, and an equal plurality of locking tab cutouts is spaced along said front articulated panel of said insert near the top edge thereof, said insert locking tabs being adapted to protrude through the respective locking tab cutouts.

17. The package of claim 4, wherein a plurality of compression tabs is spaced along said top edge of said rear articulated panel of said insert.

18. The package of claim 1, wherein a void is created between the outer sides of each of said articulated panels of said insert and the respective inner sides of said inner front panel, said bottom panel, and said back panel of said shell; and a void is created between the upper side of said at least one cover panel of said insert and the inner side of said top panel of said shell; whereby each of said voids functions as an air space surrounding said at least one card-like item when placed in said package.

19. The package of claim 18, wherein said front, top, back and bottom panels of said shell are arranged to collapse into a respective air space when a force greater than a predetermined force is exerted against any of said panels, so as to provide a degree of crush resistance for said insert and said at least one card-like item secured in the slots thereof.

20. The package of claim 18, wherein said air spaces provide a degree of shock absorption for said insert and said at least one card-like item secured in the slots thereof.

21. The package of claim 1, wherein said shell and said insert are die cut from a sheet material.

22. The package of claim 1, wherein at least the inner surfaces of said articulated panels and said at least one cover panel of said insert are coated with an anti-static coating material.

* * * * *